United States Patent [19]

Konstantouros

[11] 4,280,887

[45] Jul. 28, 1981

[54] METHOD OF REGENERATING AMMONIACAL ETCHING SOLUTIONS USEFUL FOR ETCHING METALLIC COPPER

[75] Inventor: Efthimios Konstantouros, Munich, Fed. Rep. of Germany

[73] Assignee: Siemens Aktiengesellschaft, Berlin & Munich, Fed. Rep. of Germany

[21] Appl. No.: 142,007

[22] Filed: Apr. 21, 1980

[30] Foreign Application Priority Data

Apr. 30, 1979 [DE] Fed. Rep. of Germany ..... 2917597

[51] Int. Cl.[3] ..... C02F 1/46; C25F 7/02

[52] U.S. Cl. ..... 204/150; 204/130; 204/151

[58] Field of Search ..... 204/130, 106, 103, 129.4, 204/150, 144, 151

[56] References Cited

U.S. PATENT DOCUMENTS

| | | | |
|---|---|---|---|
| 3,470,044 | 9/1969 | Radimer | 204/151 |
| 3,766,036 | 10/1973 | McKaveney | 204/150 |
| 4,035,269 | 7/1977 | Mastrorilli | 204/150 |
| 4,152,229 | 5/1979 | Soltys | 204/106 |

OTHER PUBLICATIONS

German Offenlegungsschrift 26 25 869, Published Dec. 22, 1977.

*Primary Examiner*—T. M. Tufariello

*Attorney, Agent, or Firm*—Hill, Van Santen, Steadman, Chiara & Simpson

[57] ABSTRACT

Ammoniacal etching solutions used for etching metallic copper, such as in etching galvanized printed circuits, are regenerated by electrolytically contacting a spent etching solution with a metal, such as Al or Fe, more electronegative than copper and which, in the pH range of the etching solution, forms a relatively insoluble hydroxide so that $Cu^{++}$-ions are reduced to metallic copper and the etching chemicals, $NH_3$ and $NH_4^+$, are regenerated while substantially simultaneously the more electronegative metal is oxidized into a substantially insoluble hydroxide.

11 Claims, 1 Drawing Figure

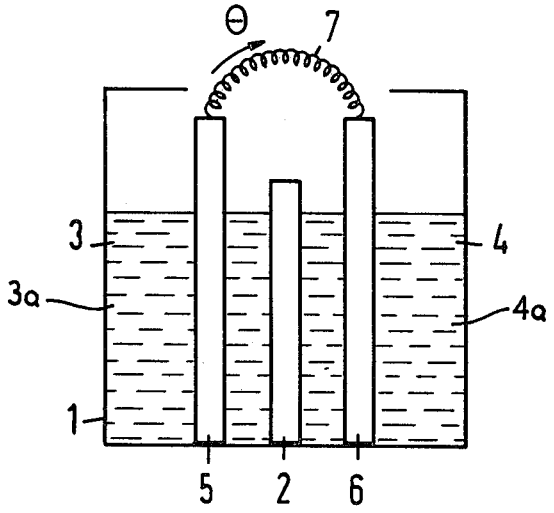
Θ
7
3
3a
1
4
4a
5
2
6

METHOD OF REGENERATING AMMONIACAL ETCHING SOLUTIONS USEFUL FOR ETCHING METALLIC COPPER

BACKGROUND OF THE INVENTION

1. Field of the Invention

The invention relates to a means of regenerating ammoniacal etching solutions used for etching metallic copper and somewhat more particularly to a method of regenerating spent ammoniacal etching solutions used in etching galvanized printed circuits and the like.

2. Prior Art

Ammoniacal etching solutions used for etching galvanized printed circuits are known. For example, German Offenlegungsschrift (DT-OS) 26 25 869 suggests the use of aqueous ammoniacal solutions in etching copper-laminated printed circuits. These etching solutions contain tetrammine copper (II) ions, ammonia and ammonium salts. During the etching of metallic copper with such a solution, the following reaction occurs:

$$Cu+[Cu(NH_3)_4]^{++}\rightarrow 2\,[Cu(NH_3)_2]^{+} \quad (A)$$

tetrammine cupric ions,
Active
diammine cuprous ion,
Inactive $$2\,[Cu(NH_3)_2]^{+}+2NH_3+2NH_4^{+}+\tfrac{1}{2}O_2\rightarrow 2\text{-}[Cu(NH_3)_4]^{++}+H_2O \quad (B)$$

The sum of reaction equations (A) and (B) provides an overall reaction, (C) as follows:

$$Cu+2NH_3+2NH_4^{+}+\tfrac{1}{2}O_2\rightarrow[Cu(NH_3)_4]^{++}+H_2O \quad (C)$$

In the above reactions, $O_2$ can be derived from atmospheric oxygen. Atmospheric oxidation of $Cu^{+}$ to $Cu^{++}$ takes place substantially spontaneously in a spray etching machine so that a separate air supply is not required.

The above referred DT-OS suggests that the ammonium salts are, preferably, comprised of a mixture of $NH_4Cl$ and $(NH_4)_2CO_3$. In its salt form, the overall reaction, for example with the chloride salt, appears as follows:

$$Cu+2NH_3+2NH_4Cl+\tfrac{1}{2}O_2\rightarrow[Cu(NH_3)_4]Cl_2+H_2O \quad (D)$$

From the foregoing, it can be seen that metallic copper, with the consumption of ammonia, ammonium salts and atmospheric oxygen, is oxidized to $[Cu(NH_3)_4]^{++}$ ions. During operation of the etching process the chemicals, $NH_3$ and $NH_4$ salts are added as needed to the etching machine via an aqueous solution, sometimes referred to as a "supplementary solution" or replenisher.

The spent etching solution contains a relatively high copper concentration and is collected as waste. This waste etching concentrate is sent to a separate copper processing operation where, apparently, the $NH_3$ is reacted with chlorine and the copper is precipitated out with scrap iron (Fe). The handling of the waste in this operation is combined with transport and processing costs.

SUMMARY OF THE INVENTION

The invention provides a method of regenerating the ammoniacal etching solution whereby, in a relatively simple manner, the chemicals used in the etching of metallic copper, $NH_3$ and $NH_4$ salts, as well as the etched copper, are recovered.

In accordance with the principles of the invention, such recycling or regeneration process comprises contacting a spent etching solution (containing a relatively high concentration of $Cu^{++}$-ions therein) with a metal which is more electronegative than copper and which, in the pH range of the etching solution, forms a relatively insoluble hydroxide, in a manner so that the $Cu^{++}$-*ions are reduced to metallic copper and the etching chemicals* ($NH_3$ and $NH_4$ salts) are reformed while the electronegative metal itself is oxidized into a relatively insoluble hydroxide.

Electronegative metals suitable for use in the practice of the invention for recovering metallic copper are selected from the group consisting of Al, Zn, Mg, Fe and mixtures thereof. Of this group of metals, Al, Fe and mixtures thereof are preferred and the most preferred electronegative metal in the practice of the invention is Al because it forms no soluble ammine complex compounds and does not release any toxic ions. With Al, the regeneration process proceeds as follows:

$$3[Cu(NH_3)_4]^{++}+2Al\rightarrow 3Cu+2Al^{+++}+12NH_3 \quad (E)$$

$$2Al^{+++}+6NH_3+6H_2O\rightarrow 2Al(OH)_3+6NH_4^{+} \quad (F)$$

The sum of reaction equations (E) and (F) provides an overall reaction equation, (G) as follows:

$$3[Cu(NH_3)_4]^{++}+2Al+6H_2O\rightarrow 3Cu+2Al(OH)_3+6NH_3+6NH_4^{+} \quad (G)$$

As can be derived from equation (G), in the presence of Al, (or any other metal which is more electronegative than copper) a substantial reversal of the etching process set forth in equation (C) above is attained.

Reaction equation (G), in the presence of a chloride salt, assumes the following form:

$$3[Cu(NH_3)_4]Cl_2+2Al+6H_2O\rightarrow 3Cu+2Al(OH)_3+6NH_3+6NH_4Cl \quad (H)$$

The overall regeneration reaction with Fe as the electronegative metal appears as follows:

$$[Cu(NH_3)_4]Cl_2+Fe+2H_2O\rightarrow Cu+Fe(OH)_2+2NH_3+2NH_4Cl \quad (I)$$

By filtering the so-reacted solution, metallic copper and the substantially insoluble hydroxide sludge, for example, $Al(OH_3)$ sludge, are separated from the so-reacted solution so that the remaining ammoniacal solution is reusable as a supplementary solution for the etching process. The precipitated metallic copper is present as a relatively heavy powder and it can be separted in a relatively easy manner from the lighter hydroxide. Further, it is to be noted that the typical characteristic of ammonia to dissolve some $Al(OH)_3$ as an aluminate is completely suppressed by the presence of $NH_4$ salts in the regenerated solution.

In a preferred embodiment of the invention, with the use of an appropriate diaphragm, copper precipitation is carried out via an internal electrolysis whereby the materials precipitated or at least separated, i.e., copper and aluminum hydoxide, are obtained on opposite sides of the diaphragm and the ammoniacal chemicals are regenerated on the cathode side of the diaphragm. This makes the regeneration process very practical and easy to operate.

BRIEF DESCRIPTION OF THE DRAWING

The FIGURE is an elevated, somewhat schematic, cross-sectional view of an apparatus useful in the practice of the principles of the invention.

DESCRIPTION OF THE PREFERRED EMBODIMENTS

The invention provides a method of regenerating spent ammoniacal etching solutions by electrolytically contacting a metal more electronegative than copper and which, in the pH range of the spent etchant medium, forms a relatively insoluable hydroxide, with such spent ammoniacal etching solution whereby cupric ions are reduced to metallic copper and the etching chemicals are regenerated while substantially simultaneously the more electronegative metal is oxidized into a substantially insoluble hydroxide.

After the regeneration process is completed, the resultant solution can be filtered to separate metallic copper and aluminum hydroxide sludge from the ammonia and ammonium salt solution.

Referring now to the drawing, an exemplary apparatus useful in the practice of the invention is illustrated as comprising a container 1 provided with a diaphragm 2 so as to sub-divide the interior of container 1 into an anode chamber 3 and a cathode chamber 4. The anode chamber 3 is filled with a relatively pure supplementary solution 3*a* (containing $NH_3$ and a $NH_4$ salt in aqueous solution) and the cathode chamber 4 is filled with a mixed solution 4*a* comprised of a supplementary solution and spent etching solution. In preferred embodiment of the invention, the ammonium salts in the supplementary solution comprise a mixture of ammonium chloride and ammonium carbonate. An electronegative metal 5, for example in the shape of a plate and comprised of aluminum, is positioned in contact, as by immersion, with the supplementary or anode solution 3*a* in anode chamber 3. The electronegative metal 5 functions a soluble anode. A metal 6 less electronegative than metal 5, for example comprised of copper, is positioned in contact with the mixed solution or cathode solution 4*a*. By establishing electrical contact between metals 5 and 6 an electrolysis begins immediately without an external current source (internal electrolysis). In this manner, the more electronegative metal 5, in the exemplary embodiment under discussion, an aluminum plate, provides electrons to the less electronegative metal 6, in the exemplary embodiment under discussion, a copper plate, and disintegrates itself into a relative insoluble hydroxide, for example $Al(OH)_3$. Thus, in the exemplary embodiment, the following reaction occurs in the anode chamber:

$$2Al + 6OH^- \rightarrow 2Al(OH)_3 + 6e^- \quad (J)$$

Substantially simultaneously with the foregoing reaction, the following reaction occurs in the cathode chamber:

$$3[Cu(NH_3)_4]^{++} + 6e^- + 6H^+ \rightarrow 3Cu + 6NH_4^+ + 6NH_3 \quad (K)$$

In the overall reaction, which is depicted by equation (G) above, solidly adhereing copper is precipitated onto metal 6 and as a solid powder along the bottom of chamber 4. In this manner, the mixed solution 4*a* in the cathode chamber 4 is completely depleted of dissolved copper and becomes a relatively pure supplementary solution suitable for etching of copper, for example in an etching machine working or etching galvanized printed circuits having a copperlaminated structure thereon. During actual operation, only a portion of such de-copperized solution is removed from chamber 4 and a substantially equal amount of spent etching solution is added to chamber 4 for substantially continuous regeneration. As indicated above, the removed supplementary solution, containing regeneration ammonia and ammonium salts, can be added, as needed, to an etching apparatus for continuous etching of additional copper. The spent waste or overflow from such an etching apparatus can be controllably fed to the cathode chamber 4 for conversion of regeneration into the supplementary solution. This process may occur in a simple batchwise manner or in a quasi-continuous manner, for example with a cascading arrangement.

The mixed cathode solution 4*a* preferably comprises, before the beginning of regenerating or electrolysis, approximately 95% (by volume) supplementary solution and about 5% (by volume) of spent etching solution. This approximate ratio of solutions is desirable because of the density difference between the respective solutions (i.e., the supplementary solution typically exhibits a density of about 1.05 g/ml and a spent etching solution having approximately 150 g of $Cu^{++}$/l, exhibits a density of about 1.2 g/ml) and to positively insure that the spent etching solution does not migrate into the anode chamber 3, i.e., to prevent direct copper precipitation on the more electronegative metal 5. The supplementary solution 3*a* in the anode chamber 3 is separated from time-to-time, as needed, for example by filtering, from the relatively insoluble hydroxide sludge, such as $Al(OH)_3$, that forms during the regeneration process and the so-cleansed solution is again utilizable as the anode solution. The removed hydroxide sludge can be further processed as desired or can be simply discarded.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim as my invention:

1. A method of regenerating ammoniacal etching solution used for etching metallic copper, comprising:

positioning a metal in contact with a spent ammoniacal etching solution, said metal being more electronegative than copper and, in the pH range of the etching solution, forming a relatively insoluable hydroxide; and causing electrolysis to occur between said metal and said spent etching solution so that $Cu^{++}$-ions in said spent etching solution are reduced to metallic copper and the etching chemicals are regenerated while substantially simultaneously said more electronegative metal is oxidized into a relatively insoluble hydroxide.

2. A method as defined in claim 1 wherein said more electronegative metal is selected from the group consisting of Al, Zn, Mg, Fe and mixtures thereof.

3. A method as defined in claim 2 wherein said more electronegative metal is selected from the group consisting of Al, Fe and mixtures thereof.

4. A method as defined in claim 1 wherein said more electronegative metal is Al.

5. A method as defined in claim 1 wherein said spent ammoniacal etching solution contains tetrammine cupric ions, ammonia and ammonium salts and said more electronegative metal is Al so that during said electrolysis, the copper which is present in said spent etching solution and the etching chemicals, ammonia and ammonium salts, are recovered in accordance with the following main reaction:

$$3[Cu(NH_3)_4^{++}+2Al+6H_2O \rightarrow 3Cu+2Al(OH)_3+6NH_3+6NH_4^+.$$

6. A method as defined in claim 5 wherein said ammonium salts comprise a mixture of ammonium chloride and ammonium carbonate.

7. A method as defined in claim 5 wherein the solution containing the recovered ammonia and ammonium salts is purified by filtration.

8. A method as defined in claim 5 wherein said spent ammoniacal etching solution is separated by a diaphragm from a replenisher solution so as to define a cathode solution comprised of said spent etching solution and an anode solution comprised of said replenisher solution, said more electronegative metal being in the form of a plate and being positioned in contact with said anode solution, a less electronegative metal in the form of a plate being positioned in contact with said cathode solution and means establishing electrical contact between said metal plates without an external current source whereby the etched copper in said cathode solution and the relatively insoluble hydroxide in said anode solution are separated-out individually.

9. A method as defined in claim 8 wherein said cathode solution comprises an admixture of about 95% replenisher solution and about 5% spent ammoniacal etching solution.

10. A method as defined in claim 8 wherein said electrolysis occurs in a batchwise manner.

11. A method as defined in claim 8 wherein said electrolysis occurs in a quasi-continuous manner.

* * * * *